US007913318B2

(12) United States Patent
Van Trojen

(10) Patent No.: US 7,913,318 B2
(45) **Date of Patent: *Mar. 29, 2011**

(54) ADJUSTABLE PADDING SYSTEM

(75) Inventor: Don Van Trojen, Mukilteo, WA (US)

(73) Assignee: Paadz Products, Inc., Everett, WA (US)

( * ) Notice: Subject to any disclaimer, the term of this patent is extended or adjusted under 35 U.S.C. 154(b) by 75 days.

This patent is subject to a terminal disclaimer.

(21) Appl. No.: 12/333,093

(22) Filed: Dec. 11, 2008

(65) Prior Publication Data

US 2009/0144883 A1 Jun. 11, 2009

Related U.S. Application Data

(63) Continuation of application No. 11/121,784, filed on May 4, 2005, now Pat. No. 7,478,439.

(51) Int. Cl.
*A41D 13/00* (2006.01)

(52) U.S. Cl. ..... 2/23

(58) Field of Classification Search ..... 2/22, 23, 2/24, 62, 455, 94, 911

See application file for complete search history.

(56) References Cited

U.S. PATENT DOCUMENTS

| | | | | |
|---|---|---|---|---|
| 5,611,081 | A | 3/1997 | Torres | |
| 5,845,333 | A | 12/1998 | Crampton | |
| 6,421,839 | B1 | 7/2002 | Vo et al. | |
| 7,089,596 | B2 | 8/2006 | Leflet et al. | |
| 7,478,439 | B2 * | 1/2009 | Van Trojen | 2/23 |
| 2002/0026664 | A1 | 3/2002 | Grounds et al. | |

FOREIGN PATENT DOCUMENTS

| | | | |
|---|---|---|---|
| EP | 0945078 | A2 | 9/1999 |

* cited by examiner

*Primary Examiner* — Tejash Patel
(74) *Attorney, Agent, or Firm* — Seed IP Law Group PLLC

(57) ABSTRACT

Adjustable padding systems for garments, incorporating a pocket and a pad. The pocket is coupled to the garment and has a wide, proximal portion and a narrow, distal portion. The pad has corresponding wide and narrow portions. The narrow portion of the pad is longer than the length of the narrow portion of the pocket, but is adjustable in length. Accordingly, the location of the wide portion of the pad along the length of the garment can be adjusted by adjusting the length of the narrow portion of the pad.

1 Claim, 6 Drawing Sheets

ADJUSTABLE PADDING SYSTEM

CROSS-REFERENCE TO RELATED APPLICATION

This application is a continuation of U.S. patent application Ser. No. 11/121,784, filed May 4, 2005, now pending, which application is incorporated herein by reference in its entirety.

BACKGROUND OF THE INVENTION

1. Field of the Invention

The present invention relates to devices and systems for providing padding over an individual's knee or elbow, and more particularly, to adjustable devices and systems that allow a pad to align with the individual's knee or elbow regardless of the length of the individual's leg or arm.

2. Description of the Related Art

Conventional knee pads, knee/shin pads, and elbow pads typically are conformed to fit over a partially-bent knee or elbow, and are held to the leg or arm using one or more straps. Each strap wraps around the leg or arm, can attach to the pad or itself, such as with a clip or a hook/loop fastener, and can be adjustable to allow the pad to fit legs or arms having different circumferences. Because the pad is mounted to surround the knee or elbow, the pad is automatically aligned with the knee and need not be adjusted.

Pants have been designed with built in pads or with pockets for receiving pads. Because a particular garment will fit different individuals differently and, thus, a particular pocket won't align with every individual's knee, the pocket must be oversized to compensate for the range of fits. Oversized pads waste material.

In one particular design, a pad is positioned in a pocket in the pants, and is suspended in the pants by a strap attached to the pants at a location above the pocket. The strap has a buckle in it, allowing each wearer to individually adjust the length of the strap, in a manner similar to a belt. By adjusting the length of the strap, the wearer can position of the pad over the knee. Belts and buckles increase the cost and complexity of manufacturing and assembling the garment.

There is a need in the industry for an improved adjustable pad for protecting an individual's knees and elbows.

BRIEF SUMMARY OF THE INVENTION

The present invention is directed toward a padding system for a garment having a body and at least one extremity projecting longitudinally therefrom, such as a pair of pants having two legs. The system generally incorporates a pocket and a pad.

In one particular embodiment, the pocket is located in the extremity, and has proximal and distal portions. The proximal portion of the pocket corresponds in orientation to the proximal portion of the extremity, and has a first lateral width. The distal portion of the pocket has a second lateral width less than the first lateral width, and has a longitudinal length. The pocket has an opening accessible from the proximal end of the extremity. The pad is sized and shaped for insertion into the opening in the pocket, has a wide portion with a width less than the first lateral width but greater than the second lateral width, and has a narrow portion with a width less than the second lateral width, such that the pad is insertable into both the distal and proximal portions of the pocket. The second portion of the pad has a length greater than the longitudinal length of the distal portion of the pocket such that the wide portion of the pad is spaced a distance apart from the distal portion of the pocket when the pad is fully inserted into the pocket. The narrow portion of the pad is adapted to facilitate its shortening to reduce the distance between the wide portion of the pad and the distal portion of the pocket and, as a result, to change the longitudinal location of the wide portion of the pad with respect to the extremity of the garment.

In another particular embodiment, the pocket has a proximal portion, a distal portion and opposing lateral sides, the proximal portion of the pocket corresponding in orientation to the proximal portion of the extremity. At least one of the sides of the distal portion of the pocket is laterally offset inward toward a longitudinal center of the pocket with respect to the corresponding side of the proximal portion of the pocket. The distal portion of the pocket has a longitudinal length. The pocket has an opening accessible from the proximal end of the extremity. The pad is sized and shaped for insertion into the opening in the pocket, and has a width selected such that the pad is insertable into the proximal portion of the pocket but not into the distal portion of the pocket due to the lateral offset of the at least one side of the distal portion of the pocket. The pad has a distal extension positioned to align with the distal portion of the pocket when the pad is inserted in the proximal portion of the pocket, and having a length greater than the longitudinal length of the of the distal portion of the pocket such that the pad is spaced a distance apart from the distal portion of the pocket when the pad is fully inserted into the pocket. The distal extension is adapted to facilitate its shortening to reduce the distance between the pad and the distal portion of the pocket and, as a result, to change the longitudinal location of the pad with respect to the extremity of the garment.

In still another embodiment, the invention is directed toward a pad comprising a body sized and shaped for insertion into a pocket in a garment. The body is selected to function as a pad. An extension projects from the body to space the body a distance apart from a terminal end of the pocket when the body and extension are fully inserted into the pocket. The distal extension is adapted to facilitate its shortening to reduce the distance between the body and the terminal end of the pocket and, as a result, to change the location of the body with respect to the garment.

BRIEF DESCRIPTION OF THE SEVERAL VIEWS OF THE DRAWING(S)

In order to assist understanding of the present invention, embodiments will now be described, purely by way of non-limiting example, with reference to the attached drawings, in which.

DETAILED DESCRIPTION OF THE INVENTION

The following detailed description is directed toward devices and systems for use in padding an individual's knee or elbow. More particularly, it is directed toward adjustable devices and systems designed to allow the pad to be positioned properly over the individual's knee or elbow, regardless of the length of the individual's arm or leg.

Figure 1:
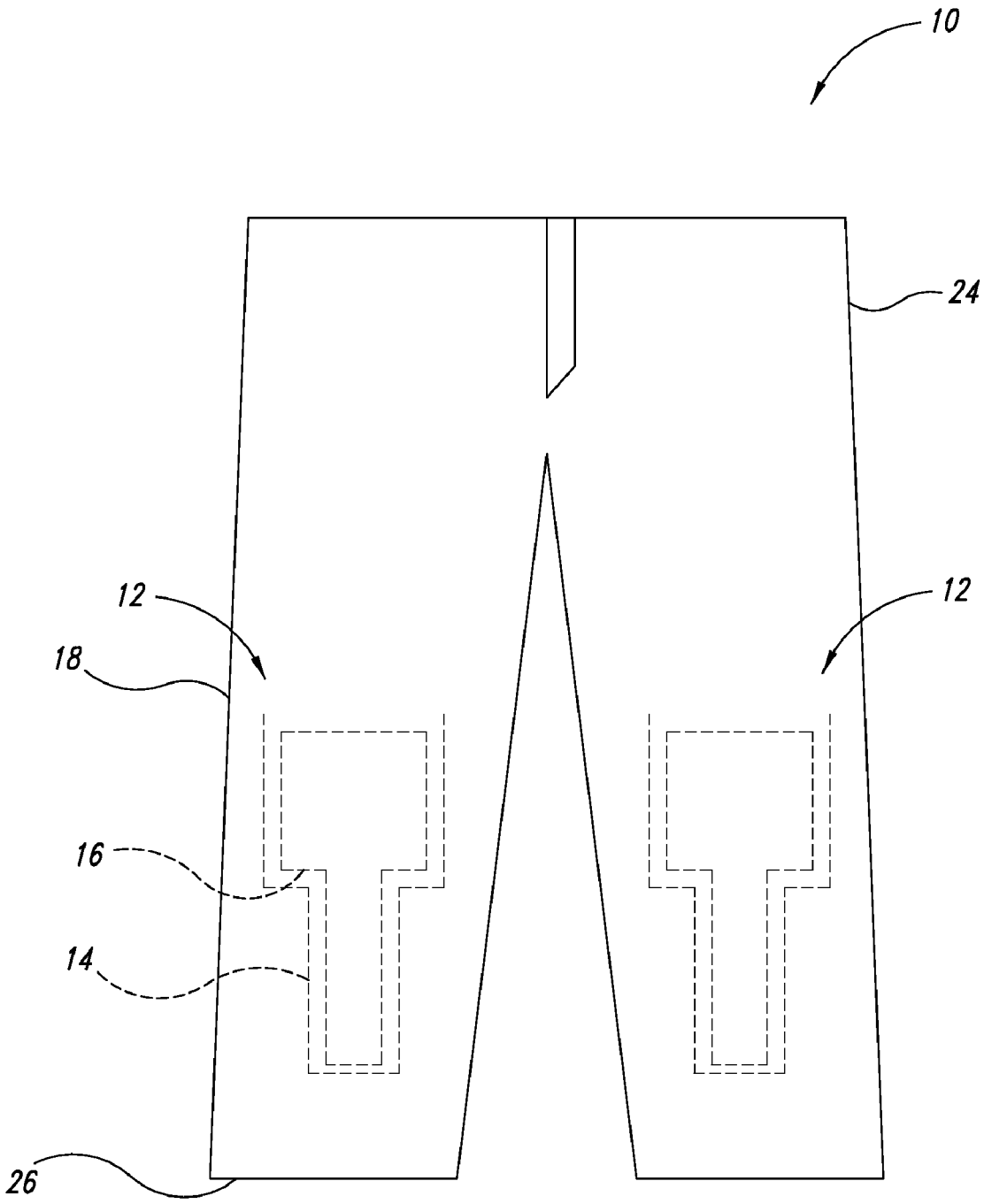
FIG. 1 is an isometric view of a pair of pants incorporating a padding system according to one particular embodiment of the present invention.

FIG. 1 shows a pair of pants 10 that incorporate a padding system 12 according to one possible embodiment of the present invention. The illustrated padding system 12 generally incorporates a pocket 14 and a pad 16. The pocket 14 can be located on an inside surface of a leg 18 of the pants 10; the pad 16 can be removably positioned within the pocket.

Figure 2:
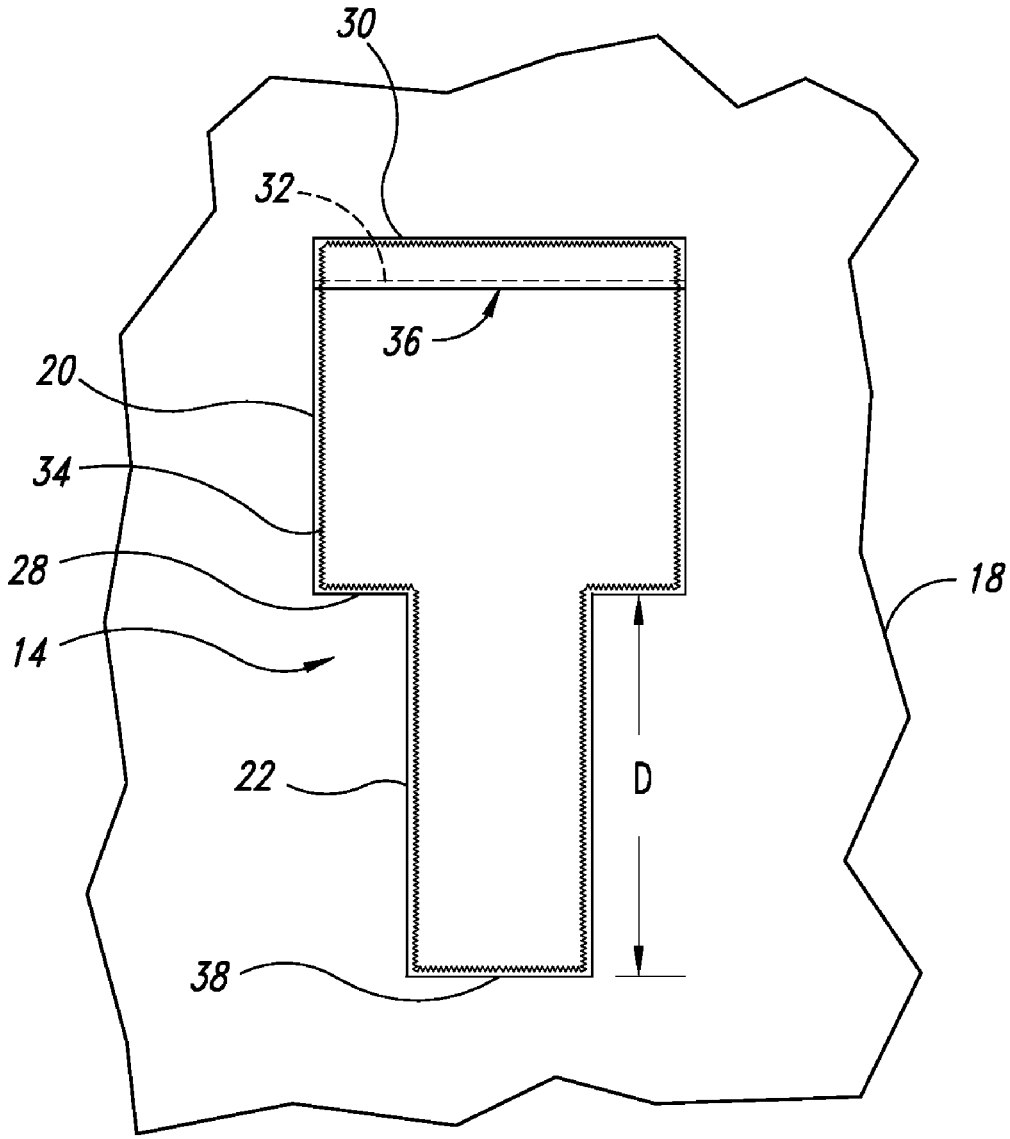
FIG. 2 is an elevation view of a portion of the pair of pants of FIG. 1, viewed from inside the pants, illustrating a pocket from the padding system of FIG. 1.

FIG. 2 better illustrates the pocket 14 of this particular embodiment of the invention. The illustrated pocket 14 has a wide portion 20 and a narrow portion 22. The narrow portion 22 of the pocket 14 is created due to the lateral offset of one, or in this instance both, of the sides of the narrow portion of the pocket with respect to the wide portion 20. As shown in FIG. 1, the wide portion 20 of the pocket 14 is located along the leg 18 at the proximal end of the pocket, closest a body 24 (FIG. 1) of the pants 10, and the narrow portion 22 of the pocket is located at the distal end, closest a terminal end 26 (FIG. 1) of the leg 18. A shoulder 28 is positioned between the wide portion 20 and the narrow portion 22 of the pocket 14.

In the illustrated embodiment, a flap 30 overlaps a proximal end 32 of the pocket 14. Stitching 34 can couple the perimeter of the pocket 14 and the flap 30 to the pants 10. The flap 30 and the proximal end 32 of the pocket 14 overlap each other, but the overlapping portions are not stitched together or to the pants. As a result, an opening 36 is formed, providing access to an interior of the pocket. As shown in FIG. 1, the pad 16 can be inserted into the pocket 14. The opening 36 allows the pad 16 to be removed from the pocket 14 and reinserted or replaced. The flap 30 can also retain the pad 16 in the pocket 14.

The narrow portion 22 of the pocket 14 terminates at a distal end 38. The distal end 38 of the pocket 14 is located a fixed depth D from the shoulder 28.

Figure 3:
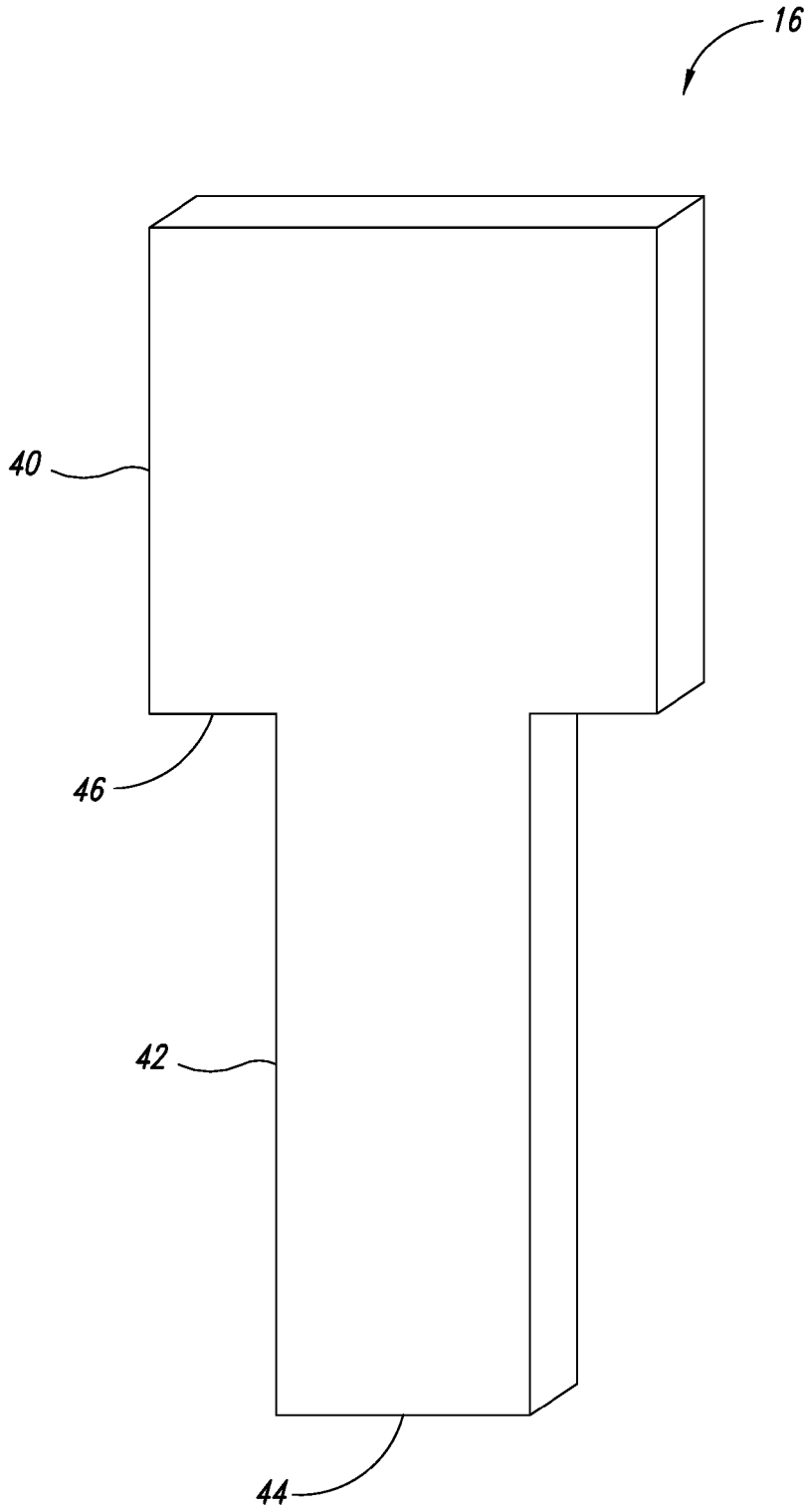
FIG. 3 is an isometric view of a pad from the padding system of FIG. 1.

FIG. 3 better illustrates the pad 16 of this particular invention. The illustrated pad 16 is shaped for use as a combination knee/shin pad. The pad 16 has a wide, knee portion 40 and a narrow, shin portion 42. As shown in FIG. 1, the knee portion 40 of the pad 16 corresponds to the wide portion 20 of the pocket 14 and the shin portion 42 of the pad corresponds to the narrow portion 22 of the pocket. Accordingly, the illustrated pad is sized and shaped to complement the pocket illustrated in FIG. 2. Thus, the knee portion 40 of the pad 16 is slightly narrower than the wide portion 20 of the pocket 14 and the shin portion 42 of the pad is slightly narrower than the narrow portion 22 of the pocket. The shin portion 42 of the pad 16 terminates at a distal end 44. The shin portion 42 of the pad 16 extends from the distal end 44 to a lower edge 46 of the knee portion 40.

The pad 16 can be made from any material or combination of materials having sufficient cushion for use as a knee pad, such as foam. In addition, the pad 16 of this particular embodiment should be made from a material sufficiently resilient to return to its general shape after being bent. As a result, the pad 16, or at least the shin portion 42 of the pad should resist folding or buckling, folding or collapsing, allowing the pad 16 to be adjustable, as discussed below.

Figure 4:
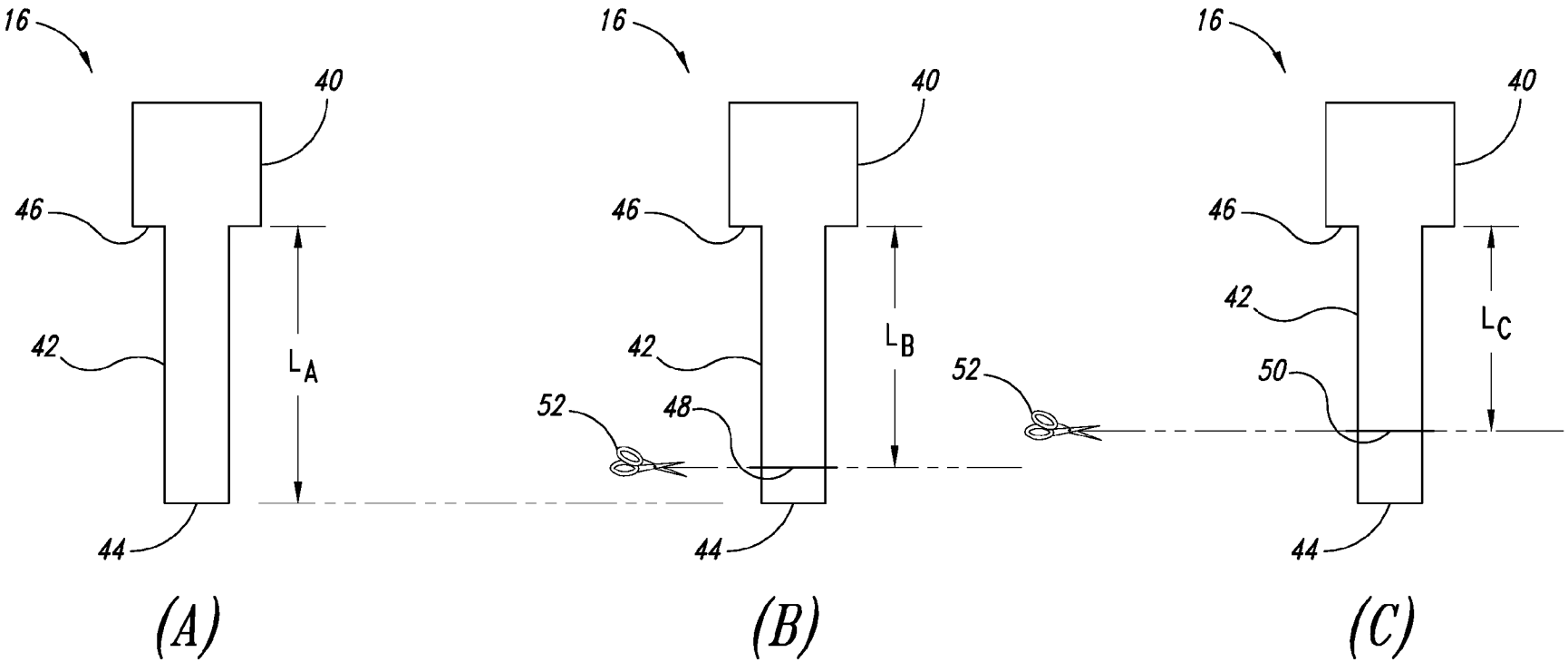
FIG. 4A is an elevation view of the pad of FIG. 3.
FIGS. 4B and 4C are elevation views schematically illustrating the pad of FIG. 3 being cut to different lengths.

FIGS. 4A-4C show the pad 16 in three different adaptations. FIG. 4A shows the pad 16 unaltered, where the lower edge 46 of the knee portion 40 is a maximum, uncut length $L_A$ as measured from the distal end 44 of the shin portion 42. FIG. 4B shows the pad 16 shortened from its original length by a first, small amount, where the lower edge 46 of the knee portion 40 is a shortened, second length $L_B$ as measured from a first cut edge 48 of the shin portion 42. FIG. 4C shows the pad 16 shortened from its original length by a second, larger amount, where the lower edge 46 of the knee portion 40 is a further shortened, third length $L_C$ as measured from a second cut edge 50 of the shin portion 42. Because the amount shortened increases from one figure to the next, the uncut length $L_A$ is longer than the second length $L_B$ and the second length is longer than the third length $L_C$. The pad 16 can be shortened by using scissors 52 or other suitable means. In certain embodiments, the pad 16 can be treated to facilitate easy and/or manual shortening, such as with perforations or other features.

Figure 5:
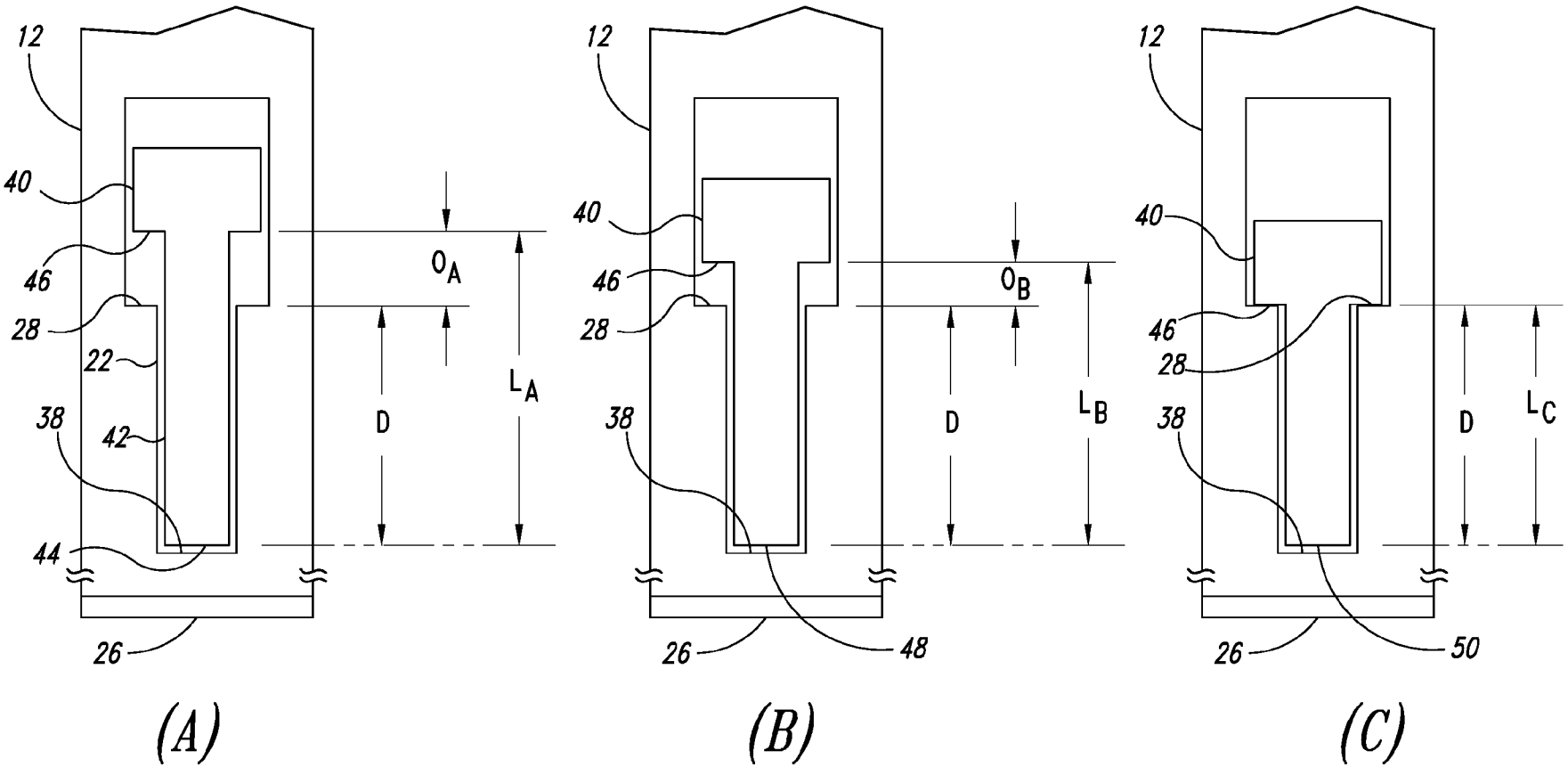
FIGS. 5A, 5B and 5C are elevation views schematically illustrating the pads of FIGS. 4A, 4B and 4C, respectively, positioned within the pocket of FIG. 2.

FIGS. 5A-5C show the padding system assembled using the three pads illustrated in FIGS. 4A-4C, respectively. In FIG. 5A the pad 16 is inserted in the pocket 14 until the distal end 44 of the shin portion 42 of the pad contacts the distal end 38 of the narrow portion 22 of the pocket. The uncut length $L_A$ of the shin portion 42 of the pad 16 is greater than the depth D of the narrow portion 22 of the pocket 14 by a maximum, first offset $O_A$, positioning the knee portion 40 of the pad a maximum distance from the terminal end 26 of the leg 12 of the pants 10. In FIG. 5B, the pad is inserted in the pocket 14 until the first cut edge 48 contacts the distal end 38 of the narrow portion 22 of the pocket. The second length $L_B$ is greater than the depth D of the narrow portion 22 of the pocket 14 by a second offset $O_B$, which is smaller than the first offset $O_A$, positioning the knee portion 40 of the pad 16 an intermediate distance from the terminal end 26 of the leg 12 of the pants 10. In FIG. 5C, the pad is inserted in the pocket 14 until the second cut edge 50 contacts the distal end 38 of the narrow portion 22 of the pocket. The second length $L_C$ is equal to the depth D of the narrow portion 22 of the pocket 14, positioning the knee portion 40 of the pad 16 a minimum distance from the terminal end 26 of the leg 12 of the pants 10. By adjusting the location of the first cut edge 48, the intermediate distance can be located anywhere between the maximum distance and the minimum distance. Thus, the knee portion 40 of the pad 16 can be positioned in any desired location along the leg 18 of the pants 10.

Figure 6:
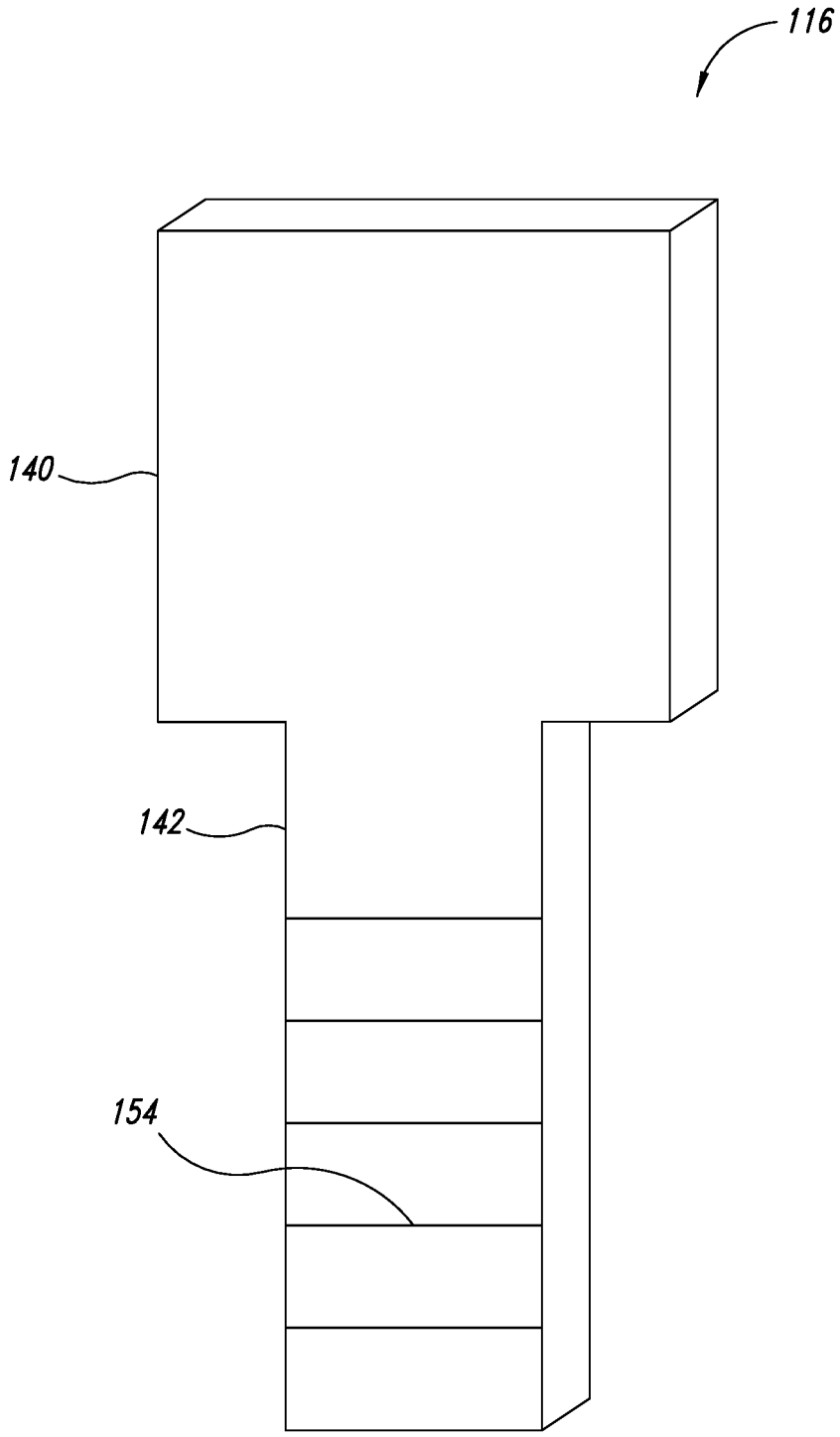
FIG. 6 is an isometric view of a pad according to an alternate embodiment of the present invention.

FIG. 6 illustrates a knee pad 116 according to one particular alternative embodiment of the present invention. The pad 116 incorporates a knee portion 140 and an extension portion 142. The knee portion 140 can be made from material similar to that described above in connection with the previous embodiment. The extension portion 142 in this particular embodiment is not a shin pad, but can be any resilient or rigid material suitable for spacing the knee portion 140 of the pad 116 along the leg 18 of the pants 10, as discussed above.

The illustrated extension portion 142 has features 154 along its length to facilitate bending or breaking the extension portion to a desired length. As a result, the extension portion can be made from a durable material that may otherwise be difficult to cut or break, providing for both durability and adjustability.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A pad for insertion into an elongated pocket in a garment, the pocket having an opening at one longitudinal end, an opposing terminal end, and a pair of laterally spaced apart obstructions within the pocket positioned longitudinally between the opening and the terminal end, the pad comprising:

a body having a length for alignment with a longitudinal axis of the pocket, the body being sized and shaped for insertion into the pocket, a width of the body being greater than the space between the obstructions to prevent the body from passing therebetween, the body being of a material selected to function as a pad, a lower edge of the body having opposing shoulders oriented at least substantially perpendicular to the length of the body; and an extension projecting from the lower edge of the body, the extension having a length greater than the distance between the obstruction and the terminal end of the pocket to space the body a desired distance apart from a terminal end of the pocket when the body and extension are fully inserted into the pocket, the extension having a width less than the distance between the obstructions to allow the extension to pass therebetween, the extension being adapted to facilitate its shortening to reduce the distance between the body and the terminal end of the pocket and, as a result, to change the location of the body with respect to the garment up to a minimum distance when the shoulders abut the obstructions.

* * * * *